US009587341B2

(12) United States Patent
Song et al.

(10) Patent No.: US 9,587,341 B2
(45) Date of Patent: Mar. 7, 2017

(54) LAUNDRY MACHINE HAVING A FLEXIBLE SEALER

(75) Inventors: Jung Tae Song, Changwon-si (KR); Soo Bong Kim, Changwon-si (KR); Ig Geun Kwon, Changwon-si (KR); Hee Tae Lim, Changwon-si (KR); Min Gyu Jo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1030 days.

(21) Appl. No.: 13/142,965

(22) PCT Filed: Dec. 29, 2009

(86) PCT No.: PCT/KR2009/007864

§ 371 (c)(1),
(2), (4) Date: Sep. 27, 2011

(87) PCT Pub. No.: WO2010/077053

PCT Pub. Date: Jul. 8, 2010

(65) Prior Publication Data

US 2012/0006070 A1 Jan. 12, 2012

(30) Foreign Application Priority Data

| | | |
|---|---|---|
| Dec. 30, 2008 | (KR) | 10-2008-0136369 |
| May 28, 2009 | (KR) | 10-2009-0047192 |
| Aug. 27, 2009 | (KR) | 10-2009-0079916 |
| Dec. 28, 2009 | (KR) | 10-2009-0131648 |

(51) Int. Cl.

| | |
|---|---|
| ***D06F 37/26*** | (2006.01) |
| ***D06F 37/04*** | (2006.01) |
| ***D06F 37/20*** | (2006.01) |
| ***D06F 37/22*** | (2006.01) |

(52) U.S. Cl.
CPC ..... *D06F 37/04* (2013.01); *D06F 37/206* (2013.01); *D06F 37/22* (2013.01); *D06F 37/263* (2013.01); *D06F 37/268* (2013.01); *D06F 37/269* (2013.01)

(58) Field of Classification Search
CPC ..... D06F 37/04; D06F 37/20; D06F 37/22; D06F 37/206; D06F 37/263; D06F 37/268; D06F 37/269; D06F 67/269
USPC ..... 68/23 A, 140
See application file for complete search history.

(56) References Cited

FOREIGN PATENT DOCUMENTS

| | | | |
|---|---|---|---|
| CN | 1724742 | A | 1/2006 |
| EP | 1 433 890 | A2 | 6/2004 |
| EP | 1 433 891 | A2 | 6/2004 |
| EP | 1 605 088 | A2 | 12/2005 |
| EP | 1 619 286 | B1 | 1/2006 |

(Continued)

OTHER PUBLICATIONS

European Search Report dated Aug. 6, 2012 issued in Application No. 09 83 6374.

(Continued)

*Primary Examiner* — Joseph L Perrin
*Assistant Examiner* — Irina Graf
(74) *Attorney, Agent, or Firm* — KED & Associates LLP

(57) ABSTRACT

The present invention relates to a laundry machine for treating laundry. One embodied laundry machine may have an opening in the rear of the tub. A flexible material is connected between the drive assembly and the rear opening of the tub for sealing therebetween. The flexible material allows the drive assembly to move or vibrate relatively to the tub. The flexible material may be referred to as a flexible sealer.

28 Claims, 6 Drawing Sheets

(56) References Cited

FOREIGN PATENT DOCUMENTS

| | | | | |
|---|---|---|---|---|
| EP | 1 710 340 | A2 | 10/2006 | |
| EP | 1 840 257 | B1 | 10/2007 | |
| KR | 10-2006-0009075 | | 1/2006 | |
| KR | 10-2007-0101009 | | 10/2007 | |
| WO | WO 2007063072 | A1 * | 6/2007 | ..... D06F 37/26 |
| WO | WO 2007/091742 | A1 | 8/2007 | |
| WO | WO 2008/103007 | A2 | 8/2008 | |

OTHER PUBLICATIONS

PCT International Search Report and Written Opinion dated Jul. 26, 2011 issued in Application No. PCT/KR2009/007864.
European Office Action dated Mar. 11, 2014 issued in Application No. 09 83 6374.
Chinese Office Action dated Dec. 25, 2012 issued in Application No. 200980155607.4 (with English translation).

* cited by examiner

LAUNDRY MACHINE HAVING A FLEXIBLE SEALER

CROSS-REFERENCE TO RELATED PATENT APPLICATIONS

This application is a U.S. National Stage Application under 35 U.S.C. §371 of PCT Application No. PCT/KR2009/007864, filed Dec. 29, 2009, which claims priority to Korean Patent Application No. 10-2008-0136369, filed Dec. 30, 2008; Korean Patent Application No. 10-2009-0047192, filed May 28, 2009; Korean Patent Application No. 10-2009-0079916 filed Aug. 27, 2009; and Korean Patent Application No. 10-2009-0131648, filed on Dec. 28, 2009.

TECHNICAL FIELD

The present invention relates to a laundry machine for treating laundry.

In general, in the laundry machine, there are washing machines and dryers.

In the washing machines, there are pulsator type washing machines and drum type washing machines. Of the washing machines, there are washing and drying machines for performing, not only washing, but also drying. In the meantime, the dryer is a machine for drying wet laundry by using hot air, or the like.

BACKGROUND ART

The drum type washing machine is provided with a tub arranged in a horizontal direction, with a drum mounted therein horizontally.

The tub holds water, and a drum is a place where the laundry is positioned and washed.

The drum is rotatably mounted in the tub.

The drum has a rotation shaft connected to a rear thereof, and the rotation shaft has rotation force transmitted thereto from a motor. Accordingly, the rotation force is transmitted from the motor to the drum through the rotation shaft to rotate the drum.

The drum rotates, not only at the time of washing, but also at the time of rinsing and even at the time of water extraction. The drum vibrates while rotating.

The rotation shaft passes through the rear wall of the tub, and projected beyond the tub. The rotation shaft is rotatably supported by a bearing housing. The bearing housing is rigidly connected to the rear wall of the tub. Therefore, the vibration is transmitted from the drum to the tub as it is.

In order to attenuate the vibration, a suspension unit is used. In general, the suspension unit is connected to the tub for supporting and damping the vibration of the tub. Accordingly, the vibration caused by the rotation of the drum is transmitted to the tub, and damped by the suspension.

DISCLOSURE OF INVENTION

Technical Problem

The present invention is to provide a laundry machine of new structure in which a tub is separated from a drive assembly in view of vibration.

In detail, the present invention provides a laundry machine of new structure which can reduce vibration of a drum transmitted to a tub.

Solution to Problem

One embodied laundry machine may have an opening in the rear of the tub. A flexible material is connected between the drive assembly and the rear opening of the tub for sealing therebetween. The flexible material allows the drive assembly to move or vibrate relatively to the tub. The flexible material may be referred to as a flexible sealer.

The flexible material may comprise a tub connection portion, a drive-assembly connection portion, and a flexible portion which connects between the connection portions.

The tub connection portion may be connected to the tub in a watertight manner. The drive-assembly connection portion may be connected to the drive assembly in a watertight manner.

The flexible portion flexibly connects the connection portions in a way that the drive assembly is allowed to move relatively to the tub.

The connection portions may be connected to the respective tub and drive assembly with watertight contact. The connection portion may be defined by surface (or surfaces) contacting to the tub or the drive assembly. Since the connection portions are three-dimensional, they may also comprises surface (or surfaces) opposite to the contacting surface (or surfaces). Accordingly, the connection portion may be defined as a portion comprising the contacting surface (or surfaces) and the opposite surface (or surfaces).

The flexible portion may be formed by being extended from the connection portions. The flexible portion may be distinguished as a portion connecting the connection portions.

The connection portions may be defined as portions which are necessary to be connected to the tub and the drive assembly. The flexible portion may be defined as a portion which is necessary to allow the drive assembly to move relatively to the tub.

The flexible portion may be made to be flexibly and elastically deformable such that the vibration can not be transmitted from the drive assembly to the tub. The flexible portion may comprise a thin curved or corrugated portion for the flexible deformation.

In this instance, the drive assembly may include the rotation shaft connected to the drum, the bearing housing which rotatably supports the rotation shaft, and the motor which rotates the rotation shaft.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made integrally with the cabinet.

Next, the tub may be supported by being fastened by screws, ribets, rubber bushings, etc. Also, the tub may be welded or bonded to the cabinet. In this cases, the supporting or fastening members have larger stiffnesses than a stiffness of the suspension unit with respect to the main direction of the vibration of the drum.

The tub may be expanded within the limits of a space in which the tub is placed. That is, the tub may be expanded until the circumferential surface thereof reaches (or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made integrally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the drum in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprises at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object (for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back (which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure. However, even in this case, a front plate forming the front face of the laundry machine may be required.

Advantageous Effects of Invention

The vibration transmitted from the drum to the tub is reduced.

In one embodiment, the tub may be expanded close to the side walls of a cabinet, and thus the drum may also be expanded. As a result, a larger capacity laundry machine may be provided.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

MODE FOR THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
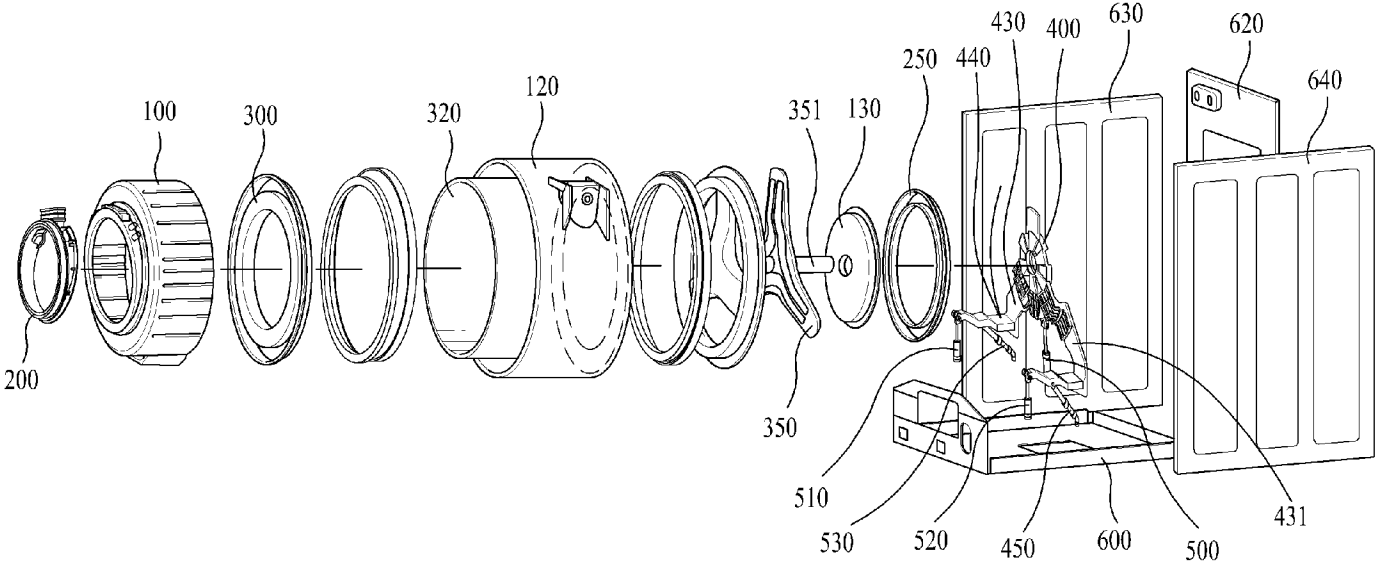
FIGS. 1 to 8 show one embodied laundry machine.

FIG. 1 illustrates an exploded perspective view of a laundry machine in accordance with a preferred embodiment of the present invention.

The laundry machine has a tub fixedly supported on a cabinet. The tub can include a tub front 100 which is a front portion thereof and a tub rear 120 which is a rear portion thereof.

The tub front 100 and the tub rear 120 can be coupled with screws, to form a space for housing the drum therein. The tub rear 120 has an opening in a rear side thereof. The tub rear 120 has a rear gasket 250 which is a flexible material connected to the opening. The rear gasket 250 can be connected to a tub back 130 at a radial direction inside thereof. The tub back 130 has a pass through hole in a center thereof through which a rotation shaft passes. The rear gasket 250 is fabricated to be deformed flexibly enough to prevent vibration from transmitting to the tub rear 120 from the tub back 130.

The rear gasket 250 is sealably connected to the tub back 130 and tub rear 120 respectively for preventing water from leaking from the tub. The tub back 130 vibrates together with the drum when the drum rotates, when the tub rear 120 is spaced from the tub back 130 such that the tub back 130 does not interfere with the tub rear 120. Since the rear gasket 250 can be deformed flexibly, enabling the tub back 130 to make relative movement without interference with the tub rear 120. The rear gasket 250 can have a curved portion or a corrugated portion 252 which can be elongated enough to allow such relative movement of the tub back 130.

The tub has a laundry opening in a front thereof. In the front of the tub having the laundry opening, there is a front gasket mounted thereto for preventing water from leaking through the laundry opening, and pieces of the laundry or foreign matters from infiltrating between the tub and the drum, or performing other functions.

The drum can have a drum front 300, a drum center 320, a drum back 340 and so on. There can be ball balancers mounted to a front and a rear of the drum, respectively. The drum back 340 is connected to a spider 350, and the spider 350 is connected to a rotation shaft 351. The drum is rotated within the tub by rotation force transmitted thereto through the rotation shaft 351.

The rotation shaft 351 is passed through the tub back 130 and connected to the motor. In the embodiment, the motor is connected to the rotation shaft, coaxially. That is, in the embodiment, the motor is directly connected to the rotation shaft. In detail, a rotor of the motor and the rotation shaft 351 is connected, directly. A bearing housing 400 is coupled to a rear 128 of the tub back 130. The bearing housing 400 rotatably supports the rotation shaft 351 between the motor and the tub back 130.

A stator 80 is fixedly mounted to the bearing housing 400. The rotor is positioned around the stator 80. As described, the rotor is directly coupled to the rotation shaft 351.

Alternatively, the motor may be coupled to the shaft indirectly. For example, the motor may be connected to the shaft by a belt and a pulley.

The bearing housing 400 is supported by the suspension unit from a cabinet 600. The suspension unit can include a plurality of brackets connected to the bearing housing 400. The suspension unit can include a plurality of suspensions connected to the plurality of brackets.

In the embodiment, the suspension unit can include three vertical suspensions and 2 suspensions mounted tilted in front/rear directions. The suspension unit is connected to the cabinet base 600, not completely fixed, but to allow a certain extent of elastic deformation to allow the drum to move in front/rear directions and left/right directions. That is, the suspension unit is elastically supported with respect to a supporting point which is connected to the base, such that a certain extent of rotation of the suspension unit is allowed in the front/rear directions and the left/right directions with respect to the supporting point. To make such elastic supporting available, the vertical suspensions can be mounted to the base 600 rubber bushings in between. The suspensions can be configured such that the vertical suspensions elastically buffer vibration of the drum, and the tilted suspensions attenuate the vibration. That is, in a vibrating system which includes springs and damping means, the vertical suspensions serve as the spring and the tilted suspensions serve as the damping means.

The tub is fixedly mounted to the cabinet, and the vibration of the drum is attenuated by the suspension unit. The tub can be fixed to the cabinet at a front and a rear thereof. The tub can be seated and supported on the base, and furthermore, even fixed to the base, too.

It may be said that the laundry machine of the embodiment is in a mode in which supporting structures for the tub and the drum are separated from each other, actually. That is, it may be said that the laundry machine of the embodiment is a laundry machine of a structure in which the tub does not vibrate even if the drum vibrates. In this instance, an amount of vibration of the drum to be transmitted to the tub varies with the rear gasket.

Different from the related art, since the laundry machine of the present invention has the vibration of the tub significantly small, enough to dispense with a gap required to maintain due to the vibration, outside surfaces of the tub can be positioned close to the cabinet to the maximum. Even if a size of the cabinet is not expanded, a size of the tub can be expanded, enabling to increase a capacity of the laundry machine for the same size of exteriors.

Actually, a gap between a cabinet right 630 or a cabinet left 640 and the tub can be as small as 5 mm. In the related art laundry machine, in which the tub vibrates with the cabinet, the gap is 30 mm for preventing the tub from interfering with the cabinet. Taking a diameter of the tub into account, the embodiment permits the diameter of the tub to expand by 50 mm more than the related art. This is a distinctive difference enough to raise the capacity of the laundry machine by one step upward for the same sized exteriors.

Figure 2:
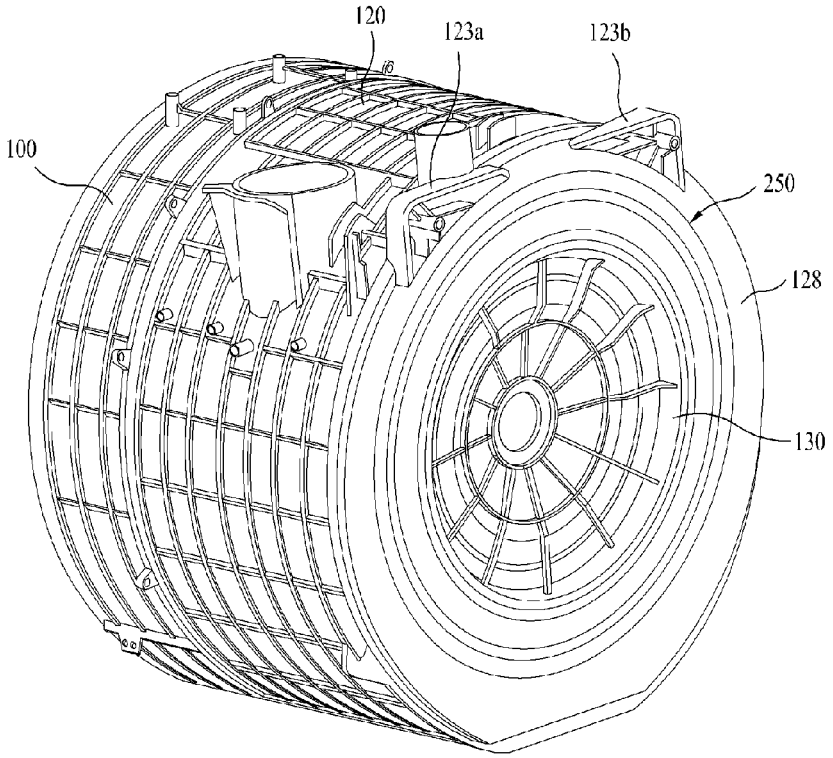

FIG. 2 illustrates a perspective view of an assembly of the tub front 100, the tub rear 120, the tub back 130, and the rear gasket 250.

The tub rear 120 is cylindrical to surround the drum, with an opened front and a donut shaped rear 128. The front is connected to the tub front 100 with a seal. The tub rear 120 may have fastening portions 123 for fastening to the cabinet with screws.

An opening in the rear surface 128 of the tub rear 120 has a diameter adequately greater than an outside diameter of the tub back 130, enabling to have an enough gap not to interfere with the rear surface 128 of the tub rear 120 even if the tub back 130 vibrates.

Between the rear surface 128 of the tub rear 120 and the tub back 130, the rear gasket 250 is connected. The rear gasket 250 seals between the rear surface 128 and the tub back 130. The rear gasket 250 has a corrugated portion 252 which can be adequately deformed flexibly enough to prevent transmission of the vibration from the tub back 130 to the tub rear 120.

The corrugated portion 252 can be formed by forming the gasket with a curve. The rear gasket, connected to the tub back 130 or the tub rear 120, can be formed to have the curve such that the rear gasket is projected forward or backward with reference to a connection portion thereof. Or, the rear gasket 250 can be projected backward (an outside of the tub) of the rear surface 128 more than forward (i.e., an inside of the tub) of the rear surface 128 with reference to the rear surface 128 of the tub rear 120, which is favorable for interference with the spider and the drum which rotate in front.

Depending on cases, the corrugated portion 252 may be formed to have the backward projection without the forward projection.

In detail, the corrugated portion 252 can be formed such that the corrugated portion 252 is curved to project forward at a connection portion with the tub rear 120, curved to project backward, and curved forward again where the corrugated portion is connected to the tub back 130. In this instance, an extent of the backward projection can be greater than the extent of the forward projection. That is, with reference to the connection portion (this portion can be defined as a point where a fastening ring is positioned) where the corrugated portion is connected to the tub rear 120 or the tub back 130, a front/rear direction width of the forward projection can be smaller than a front/rear direction width of the backward projection.

Moreover, a developed length of a backward projection of the corrugated portion (a length when the corrugated portion is stretched, or a curve length of the curve) can be greater than a developed length of a forward projection of the corrugated portion on an upper or lower side of the backward projection. Furthermore, the developed length of the backward projection of the corrugated portion can be greater than a sum of the developed lengths of the forward projections of the corrugated portion on an upper or lower side of the backward projection.

In the corrugated portion 252, it may be called that a curved portion projected forward from the connection portion connected to the tub rear 120 is as an outer corrugated portion, a curved portion connected to the outer corrugated portion and projected backward is as a middle corrugated portion, and a curved portion projected forward and connected to the connection portion which is connected to the tub back 130 is as an inner corrugated portion. In this instance, a radial direction width of the middle corrugated portion can be greater than a radial direction width of the outer or inner corrugated portion. In addition to this, the radial direction width of the inner corrugated portion can be greater than the radial direction width of the outer corrugated portion. Since the inner corrugated portion is positioned relatively close to the tub back that vibrates with the drum, it can be favorable that the radial direction width of the inner corrugated portion is greater than the radial direction width of the outer corrugated portion.

It can be favorable that the outer corrugated portion is projected forward less than the inner corrugated portion. Because the drum can have rotational movement with respect to a left/right direction axis, when a front/rear direction movement is the greater as a portion of the drum goes the farther from the rotational axis, the outer corrugated portion is projected forward less than the inner corrugated portion for avoiding interference with the drum or the spider.

Figure 3:
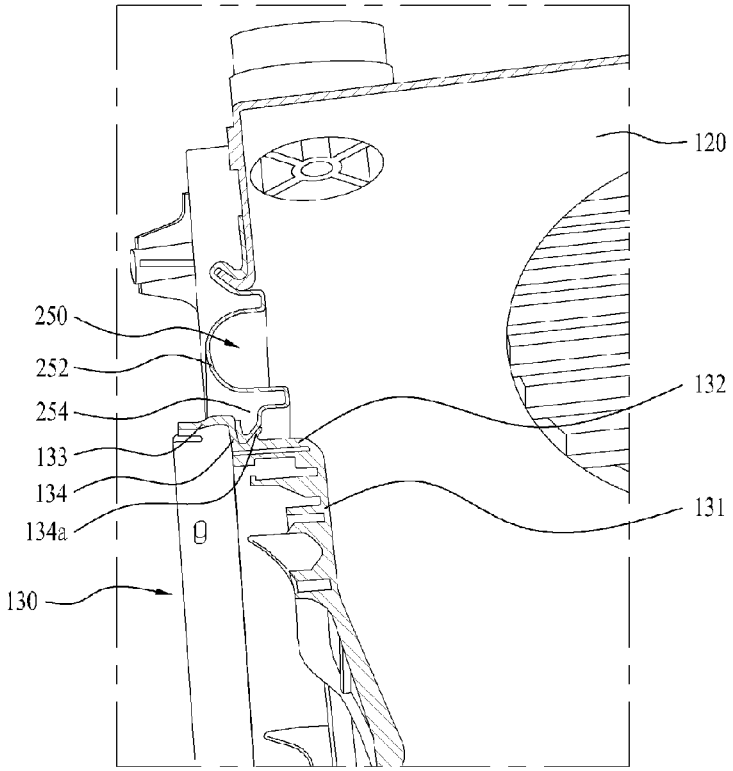

FIG. 3 illustrates a section showing a state the tub rear 120, the rear gasket 250 and the tub back 130 are connected.

At an inside circumference of the rear surface 128 of the tub rear 120, there is a rear gasket joint bent backward and bent in an outer direction in a radial direction.

There is a fastening ring (not shown) around a neck portion of the rear gasket joint for securing the rear gasket joint to the tub rear 120.

As described before, the rear gasket joint 128*a* has the corrugated portion 252 not to give influence to the vibration of the tub back 130.

The tub back 130 can include a center portion 131, a rim portion 132 extended backward from the center portion 131, and a seating portion 134 extended in a radial direction from the rim portion 132. On an outside surface of the rim portion 132, there is a rib 134*a*. Between the rib 134*a* and the seating portion 134, there is a groove in which the rear gasket 250 is mounted. Of the rear gasket 250, a portion placed in the groove has a groove 254 outside of which the fastening ring is positioned to fasten the rear gasket 250 to the rim portion 101.

On a top of the tub back 130, there is a water wall 133 for preventing the water from falling onto the motor. The water wall 133 is extended backward from the seating portion 134.

Figure 4:
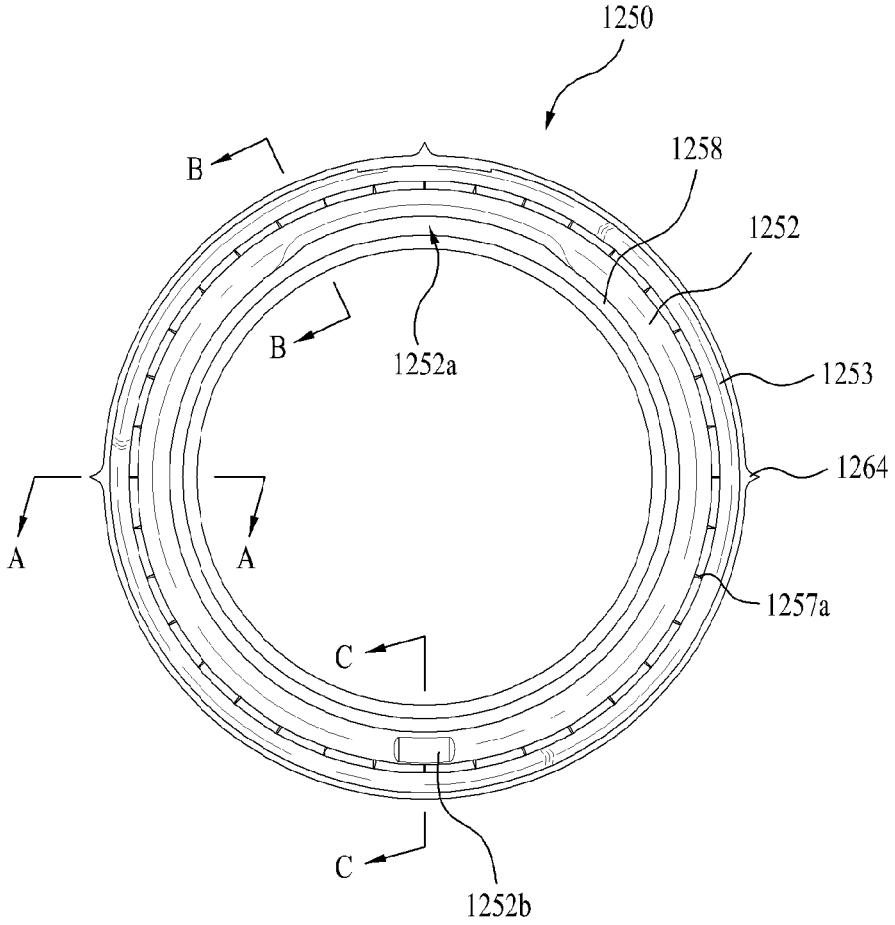
Figure 5:
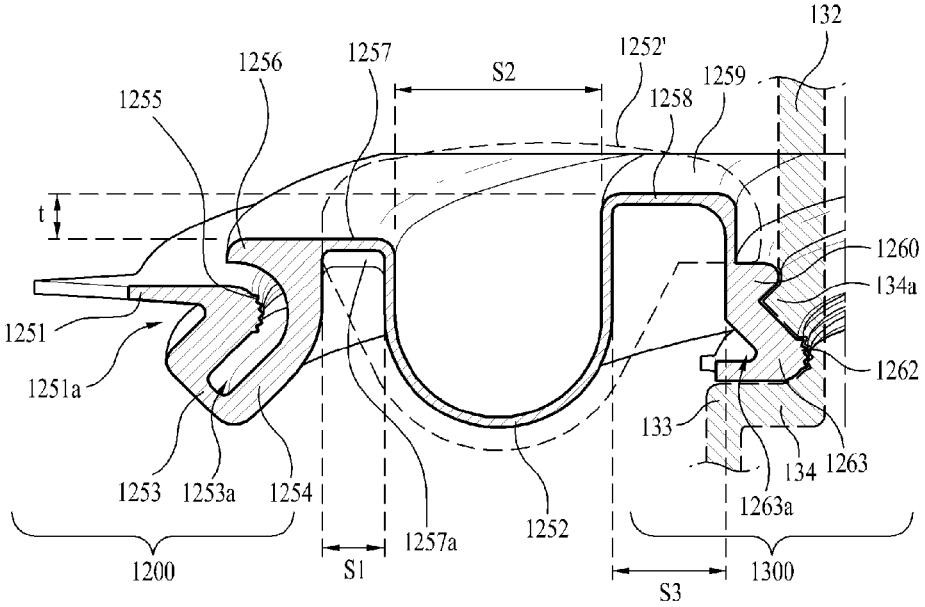
Figure 6:
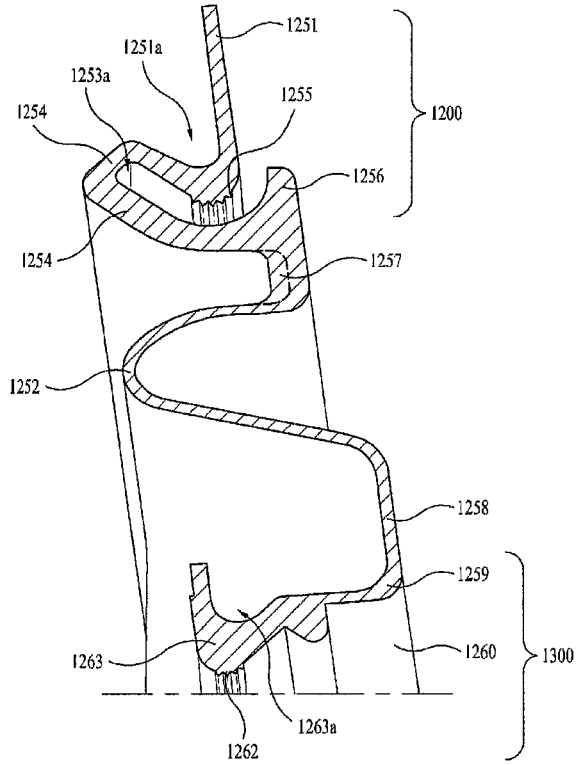
Figure 7:
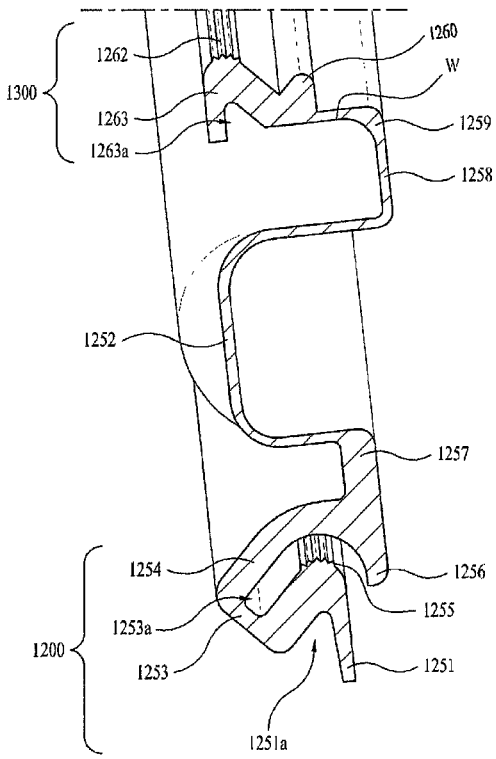

In the meantime, FIGS. 4 to 7 illustrate another embodiment of the rear gasket 1250. FIG. 4 illustrates a front view of the rear gasket 1250, FIG. 5 illustrates a section across a line A-A in FIG. 4, FIG. 6 illustrates a section across a line B-B in FIG. 4, and FIG. 7 illustrates a section across a line C-C in FIG. 4.

Referring to FIGS. 4 and 5, the rear gasket 1250 includes a tub connection portion which is connected to the tub rear 120, a drive-assembly connection portion for fastening to the tub back 130, and a flexible portion 1252'. Referring to FIG. 5, the tub connection portion and the drive-assembly connection portion are located radially outside and inside the flexible portion 1252', respectively.

In this embodiment, the tub connection portion may be referred to as a tub rear fastening portion 1200. In addition, since the drive assembly comprises a tub back 130 which is connected to the flexible material 1250, the drive-assembly connection portion may be referred to as a tub back fastening portion 1300. The flexible portion 1252' may comprise a corrugated or curved portion 1252.

As described before, the rear gasket 1250 serves to prevent the vibration from transmitting to the tub from the motor. That is, the tub, the motor and the drum including the tub front 100 and the tub rear 120 are made to be included to vibration systems different from one another owing to the rear gasket 1250 among which no vibration transmits. Therefore, it is preferable that the rear gasket 1250 is formed of a flexible material that can cut off transmission of the vibration from the motor to the tub rear 120 through the tub back 130.

In the meantime, the rear gasket 1250 forms, together with the rear surface 128 of the tub rear 120 and the tub back 130, the rear wall of the space where the drum is placed. Since the tub serves to hold the water, if the tub holds the water, a pressure acts thereon by gravity of the water. The pressure of the water acts to the rear wall of the tub. Accordingly, if the rear gasket 1250 is flexible exceedingly, the rear gasket 1250 is likely to deform or broken failing to withstand the pressure if a pressure acts thereon due to the water.

If a lower side of the rear gasket 1250 is submerged under the water following supply of the water, a load is applied to the rear gasket 1250 as if something pulls down the rear gasket 1250 due to the water pressure, leading an upper side of the rear gasket 1250 to deform. Particularly, due to the load, buckling can take place at a portion of the rear gasket 1250 which is not submerged under the water. In order to reduce such a problem, the water can be supplied to a water level at which a small portion of the lower side of the rear gasket 1250 is submerged as far as possible in a washing course, or in a water supply course. Particularly, if the corrugated portion of the rear gasket is submerged completely, since the deformation on the upper side of the rear gasket can cause a problem due to the water pressure, it can be made that the water is supplied such that at least the corrugated portion is not submerged completely. Or, it can be made that the water is supplied below a low most portion of an inside diameter of the rear gasket or a low most portion of the tub back. In the meantime, it can be made that the water is supplied to a water level at which the rear gasket is not submerged almost. For an example, it can be made that the water is supplied below an under side of the corrugated portion of the rear gasket, or the water is supplied to a lowest point of an inside circumference (a portion connected to the rear gasket) of the opening in the rear of the tub rear.

An amount of the water supplied to above water level can vary with a size of the rear gasket. For an example, if the diameter of the rear gasket is too large, there will be shortage of an absolute amount of the water if the water is supplied to above level. Accordingly, the diameter of the rear gasket can be determined taking above water level and the absolute amount of the water depending on the water level into account.

The rear gasket 1250 may be deformed by the pressure of the water inside the tub. In this case, the rear gasket 1250 may be made not to deformed to interfere with a suspension 500 which is behind the gasket. If the gasket 1250 is too flexible, it may interfere with the suspension by being deformed by the water pressure. In FIG. 7, when water is supplied into the tub until the water reaches the lowest portion (w) of the inner circumference of the flexible portion, the rear gasket 1250 may be made not to be deformed to interfere with the suspension 500 by the water pressure.

While it is required that the rear gasket 1250 has flexibility for cutting off the vibration, it is also required that the rear gasket 1250 is formed of a material having properties, rigidity and strength for enduring repetitive deformation caused by the water pressure and the operation of the laundry machine.

The configuration of the rear gasket 1250 of the material will be described with reference to the attached drawings.

Referring to FIG. 5, the tub rear fastening portion 1200 of the rear gasket 1250 can include a first extension 1251 and an inserting portion 1253*a* for placing the rear gasket joint 128*a* of the tub rear 120 therein. In FIG. 5, with reference to the rear gasket 1250, an upper side is an inside of the tub, and a lower side is an outside of a rear of the tub.

At the inside circumference of the rear surface 128 of the tub rear 120, there is the rear gasket joint 128*a* bent backward and bent in an outer direction in a radial direction. In the meantime, at the tub rear fastening portion 1200 of the rear gasket 1250, there is an inserting portion 1253*a* having a first inserting groove formed therein for inserting the rear gasket joint 128*a*.

The rear gasket joint 128*a* has a shape in which the rear gasket joint 128*a* is curved backward in a radial direction for avoiding interference with the drum or the spider in front of the rear gasket joint 128*a*. That is, the rear gasket joint 128*a* is extended backward from an edge of the opening in the rear surface 128 of the tub rear 120 and therefrom extended in a radial direction. The shape of the rear gasket joint 128*a* enables firm jointing of the rear gasket by forming a groove to the rear surface 128 of the tub.

In conformity with the shape of the rear gasket joint 128*a*, the tub rear fastening portion 1200 has the first inserting groove 1253*a*. In detail, tub rear fastening portion 1200 has an inserting portion 1253 projected to backward and radial direction of the tub, in an inside of which the first inserting groove 1253*a* is formed. At the end, as the rear gasket joint 128*a* of the tub rear 120 is inserted in the first inserting groove 1253*a*, the tub rear 120 and the tub rear fastening portion 1200 are connected to each other.

In the meantime, the laundry machine further includes a first fastening ring (not shown) for surrounding an outside of the inserting portion 1253 of the tub rear fastening portion 1200. The first fastening ring surrounds an outside of the inserting portion 1253 while compressing the tub rear fastening portion 1200 toward the rear gasket joint 128*a*. That is, tub rear fastening portion 1200 has a first extension 1251 bent from the inserting portion 1253 and extended in a radial direction, and the first fastening ring is seated on the second inserting groove 1251*a* between the inserting portion 1253 and the first extension 1251. As the first fastening ring compresses the tub rear fastening portion 1200 against the rear gasket joint 128*a*, the rear gasket 1250 can be fastened to the tub rear 120, firmly.

The first extension 1251 of the tub rear fastening portion 1200 is brought into close contact with a surface of the rear wall 128 of the tub rear 120 if the rear gasket joint 128*a* is inserted, to enhance a fastening force between the tub rear 120 and the tub rear fastening portion 1200.

In the meantime, at a connection portion which connects the first extension 1251 to the inserting portion 1253, there can be a first uneven portion 1255. The first uneven portion 1255 has a plurality of uneven parts for enhancing fastening force between the tub rear 120 and the tub rear fastening portion 1200 if the rear gasket joint 128*a* is inserted in the first inserting groove 1253*a*. The first uneven portion 1255 prevents water from leaking by bending an interface between the rear gasket joint 128*a* and the rear gasket 1250 for a plurality of times in a case the water leaks from the tub along the inserting groove 1253*a*.

A first connection portion 1257, which will be described later, can have a second extension 1256 extended towards the first extension 1251. The second extension 1256 covers a curved portion of the rear gasket joint 128*a* which is bent from the rear wall 128. It makes infiltrating of the water of the tub into the first inserting groove 1253*a* difficult, thereby prevents the water from leaking from the tub.

In the meantime, the second extension also serves to prevent the rear gasket 1250 from sagging in a case the tub holds the water, or the tub rear fastening portion 1200 from falling off the rear gasket joint 128*a* due to the water pressure.

That is, referring to FIG. 7 (a section across a line C-C in FIG. 4), a pressure is applied to the rear gasket 1250 toward an outside of the corrugated portion 1252 due to gravity of the water. Due to the pressure, the corrugated portion sags, and if the pressure is high, the rear gasket joint 128*a* can fall off the first inserting groove 1253*a*. Therefore, the second extension is projected so as to be held at the rear gasket joint 128*a*, for preventing the rear gasket 1250 from sagging or falling off.

In the meantime, referring to FIGS. 4 and 5 again, a tub supporting portion 1254 of the rear gasket 1250 serves the rear gasket joint 128*a* not to move away from the first inserting groove 1253*a*. Therefore, it is preferable that the tub supporting portion 1254 has a predetermined thickness thicker than the corrugated portion, for an example, about 3~4 mm in the embodiment.

The inserting portion 1253 is connected to the corrugated portion 1252 with the first connection portion 1257. The corrugated portion projected backward of the tub for absorbing vibration of the motor, thereby preventing the vibration from transmission to the tub rear 120 from the motor. In the meantime, there are cases when the drum vibrates in up/down directions at the time the drum rotates, when it is preferable that a length of the corrugated portion 1252 is greater than a maximum amplitude of the up/down direction vibration of the drum. If the length of the corrugated portion 1252 is similar to, or smaller than the maximum amplitude of the up/down direction vibration of the drum, a case will takes place when the corrugated portion 1252 is stretched fully by the up/down direction vibration. If the corrugated portion 1252 is stretched fully so as to be extended, the vibration can not be cut off effectively, transmitting a portion of the vibration to the tub rear 120. At the end, such tensile deformation of the corrugated portion serves as another spring for the drum, giving an unexpected influence to the vibration of the drum, and making a load applied to the corrugated portion 1252 which can cause deformation or damage to the corrugated portion 1252.

In the meantime, a load of the rear gasket 1250 itself and the pressure of the water can be applied to the first connection portion 1257 which connects the corrugated portion 1252 to the inserting portion 1253, to deform the first connection portion 1257. Therefore, in the embodiment, in order to prevent the deformation, a plurality of ribs 1257*a* may be provided along the first connection portion 1257 in a radial direction. At the time the water is supplied to the tub more than a certain amount at the time of washing or rinsing, when the lower side of the rear gasket 1250 can be submerged under the water. Due to this, the rear gasket 1250 has a load applied thereto as if the rear gasket is pulled downward, making the rear gasket 1250 to deform non-uniformly to cause buckling at some of positions. Since the buckling causes deformation as if the rear gasket distorts, the buckling is not desirable. The plurality of ribs 1257*a* are provided for reducing the buckling. The ribs 1257*a* may be formed at other portions of the rear gasket 1250.

The corrugated portion 1252 is connected to the tub back fastening portion 1300 with the second connection portion 1258. The tub back fastening portion 1300 includes a bent portion 1259 connected to the second connection portion 1258 and a groove 1263 projected downward.

The bent portion 1259 is bent backward from the second connection portion 1258. In this case, in order to prevent the bent portion 1259 from bending by a load applied to the bent portion 1259, it is preferable that the bent portion 1259 has a thickness greater than the foregoing embodiment. For an example, the bent portion 1259 may have a thickness of about 3~4 mm. If the bent portion 1259 is thin making the bent portion 1259 too flexible, the deformation of the bent portion becomes greater, making the corrugated portion sag down more, causing interference with the fastening ring on an upper side. The interference may cause the rear gasket torn off. Particularly, if the fastening ring is a clamp spring, interference with the spring can cause tearing. Accordingly, the thickness of the bent portion is formed relatively thicker for reducing sagging of the corrugated portion. In this point of view, the bent portion can be formed thicker than at least a thickness of the corrugated portion, and even thicker than a portion of the bent portion connected to the corrugated portion at an upper side thereof.

The tub back fastening portion 1300 is fastened to the tub back 130 as a circumference of the tub back 130 surrounds and compresses the tub back fastening portion 1300. As described before, the tub back 130 includes a center portion 131 projected forward slightly, and a rim portion 132 extended backward from the center portion 131. The tub back 130 also includes a seating portion 134 extended in a radial direction from the rim portion 132. There is a rib 134*a* on an outside surface of the rim portion 132. There is a groove between the rib 134*a* and the seating portion 134, to which the rear gasket 1250 is fastened.

The rear gasket 1250 is fastened to the tub back 130 as the rib 134*a* at the rim of the tub back 130 and the seating portion 134 of the tub back 130 surrounds and compresses the groove 1263 at the tub rear fastening portion 1200 of the rear gasket 1250. That is, the rear gasket 1250 is fastened to the tub back 130 as the groove 1263 of the tub back fastening portion 1300 is placed in the groove. Moreover, as a second fastening ring (not shown) is positioned in a third inserting groove 1263A on an inside of the groove 1263, making the groove 1263 to compresses the rim portion 132, a fastening force between the rear gasket 1250 and the tub back 130 is enhanced.

On an outside of the groove 1263, there is a second uneven portion 1262 for enhancing fastening force in a case the groove 1263 is placed in the groove between the rib 134*a* and the seating portion 134. In a case the water leaks from the tub along a space between the rear gasket 1250 and the tub back 130, the uneven portion 1262 prevents the water from leaking by bending an interface between the rear gasket 1250 and the tub back 130 a plurality of times.

Moreover, the tub back fastening portion 1300 has a projection 1260 for preventing the water from leaking. In detail, the projection 1260 is projected to be held at the rib 134*a* of the tub back 130 such that the projection 1260 is held at an end of the rib 134*a* if the groove 1263 is placed in the groove between the rib 134*a* and the seating portion 134. Therefore, by bending an interface between the groove 1263 and the rib 134*a*, leakage of the water is prevented.

In the meantime, it is preferable that the first connection portion 1257 of the tub rear fastening portion 1200 and the second connection portion 1258 of the tub back fastening portion 1300 in the rear gasket 1250 are projected toward an inside of the tub at extents different from each other (in FIGS. 5 and 6, an upper side of the rear gasket 1250 is the inside of the tub).

That is, as described before, the drum back 340 of the drum is connected to the spider 350, the spider 350 is connected to the rotation shaft 351, and the rotation shaft 351 is passed through the tub back 130 and directly connected to the motor. Moreover, the rear surface 128 of the tub back 130 is coupled to the bearing housing 400. Therefore, if the rear gasket 1250 connects the tub back 130 to the tub rear 120, the spider 350 is in an inside of the rear gasket 1250, i.e., inside of the tub.

In above configuration, if the drum rotates, the drum may vibrate in front/rear directions. Therefore, if the drum vibrates in the front/rear directions, the spider 350 at the drum back 340 can be brought into contact with the rear gasket 1250. Particularly, the front/rear direction vibration can become the greater as a position of vibration goes farther from the rotation shaft the more. Therefore, in a case the spider 350 is brought into contact with the rear gasket 1250, a possibility of the first connection portion 1257, that is positioned farther than the second connection portion 1258 from the rotation shaft 351, being brought into contact with the spider 350 is higher than a possibility of the second connection portion 1258 being brought into contact with the spider 350. Accordingly, in order to prevent the first connection portion 1257 of the rear gasket 1250 from being deformed and damaged by the spider 350 when the drum vibrates in the front/rear directions, the embodiment suggests the first connection portion 1257 is projected more than the second connection portion 1258 toward the rear of the tub. That is, as shown in FIGS. 5 and 6, in comparison to the second connection portion 1258, the first connection portion 1257 is positioned in a rear direction by a predetermined distance t.

In the meantime, it is preferable that the second connection portion 1258 has an adequate length (s3) enough to prevent the corrugated portion 1252 and the tub back fastening portion 1300 from being brought into contact with each other. That is, if the drum vibrates in up/down directions by rotation of the drum, if the second connection portion 1258 is too short, a portion of the corrugated portion 1252 and the tub back fastening portion 1300 can be brought into contact with each other and damaged. Alikely, a length (s1) of the first connection portion 1257 can be maintain such that the corrugated portion 1252 and the tub rear fastening portion 1200 are not brought into contact with each other at the time of vibration of the drum. Because movement of the tub back fastening portion 1300 is greater than movement of the tub rear fastening portion 1200, the first connection portion 1257 can be smaller than the second connection portion 1258. Due to the enough lengths of the first and second connection portions 1257 and 1258, self contact is prevented. Further, the connection portions 1257 and 1258 are straight and inclined at an angle less than 45 degree with respect to a normal axis to the shaft. The angle may be within 5 degree. Due to the straight portions, the corrugated portion 1252 are mainly deformed when the drum vibrates. The straight portions may be thicker than the corrugated portion.

The first connection portion 1257 may be referred to as an outer straight portion, since it is located radially outside the corrugated portion 1252. The second connection portion 1258 may be referred to as an inner straight portion, since it is located radially inside the corrugated portion 1252.

The flexible portion 1252' may be made thicker than the tub connection portion or the drive-assembly connection portion. Further, the flexible portion 1252' may be made non-uniform in thickness so that it is made non-uniform in flexibility and self contact is prevented in the flexible portion 1252' itself. To this end, the flexible portion 1252' may comprise ribs 1257*a*. The flexible portion 1252' is non uniform in thickness with a cross section cutting the rib.

The radial width of the flexible portion 1252' may be greater than 10 mm. The width may be determined with considering the greatest displacement of the drive assembly in the direction normal to the rotational axis of the shaft.

The rear gasket 1250 may comprise 3 couples of surfaces. Each couple have two surfaces facing each other in the radial direction. Among the couples, the middle couple may have the largest interval between the two surfaces. In FIG. 5, the interval (s2) is larger than the intervals (s1, s3)

The interval (s2) of the middle couple may be most greatly changed when the drum vibrates. The interval (s2) of the middle couple may be larger than a third the radial width of the flexible portion 1252'.

The flexible portion 1252' may be made to be displaced more toward the opposite side of the drum, when the drive assembly is displaced in a normal direction to the axial direction of the shaft. It helps to prevent the flexible portion from interfering with the drum. In the embodiment, the corrugated portion 1252 is located opposite to the drum with respect to the connection portions 1257 and 1258, so the center of weight of the flexible portion 1252' is located behind the connection portions 1257 and 1258. The flexible portion 1252' may be deformed to be displaced rearward as a whole.

In the meantime, referring to FIG. 4, there is a first escape recess 1252*a* along the corrugated portion 1252 of the rear gasket 1250 at a predetermined portion thereof. The first escape recess 1252*a* serves to prevent a spring portion of the second fastening ring from being in contact with the corrugated portion 1252 in a case the clamp spring is mounted to the third inserting groove 1263*a* as the second fastening ring.

Particularly, the first escape recess 1252*a* prevents the spring portion of the second fastening ring from being in contact with the corrugated portion 1252. The second fastening ring may be provided with a spring for applying an elastic force to the tub back fastening portion 1300 for compressing the tub back fastening portion 1300, and the spring can be brought into contact with the corrugated portion 1252 due to vibration in a case the drum rotates. If the spring is brought into contact with the corrugated portion 1252, the corrugated portion 1252 can be deformed and damaged. In order to prevent this, the embodiment suggests providing the first escape recess 1252*a* at a position matching to the spring of the second fastening (or clamp) ring.

The first escape recess 1252*a* can be seen the best in FIG. 6. Referring to FIG. 6, it can be known that the second connection portion 1258 where the first escape recess 1252*a* is formed has a length longer than the second connection portion 1258 where no first escape recess 1252*a* is formed.

In the meantime, the suspension 500 at a center of the rear of the tub is directly connected between the bearing housing 400 and the base 600. Therefore, since the bearing housing 400 is fixed to the rear of the tub back 130, a portion of the rear gasket 1250 connected to the tub back 130 can interfere with the suspension 500. As shown in FIG. 4, in order to avoid such interference, the rear gasket 1250 may have a second escape recess 1252*b* at a predetermined portion of a lower portion of the rear gasket 1250.

Referring to FIGS. 4 and 7, the second escape recess 1252*b* can be provided at the corrugated portion 1252 projected backward the most from the lower portion of the rear gasket 1250. The second escape recess 1252*b* can be verified by comparing FIG. 5 to FIG. 7. It can be known that, in comparison to FIG. 5, the corrugated portion 1252 having the second escape recess 1252*b* formed therein shown in FIG. 7 is projected backward less than FIG. 5. That is, the second escape recess 1252*b* is provided for preventing interference with the third cylinder spring 500.

In the meantime, if the rear gasket 1250 is mounted, guide means may be provided for correct positioning of the rear gasket 1250. The correct positioning can be defined that the suspension 500 is arranged at the second escape recess 1252*b*, exactly. The embodiment suggests providing at least one positioning projection 1264 at a predetermined position of the rear gasket 1250, a mark (not shown) corresponding to a positioning projection 1264 can be provided at the rear wall 128 of the tub rear 120. When it is intended to mount the rear gasket 1250, the rear gasket 1250 is placed such that the positioning projection 1264 is aligned with the mark, and the rear gasket joint 128*a* of the tub rear 120 is placed in the first inserting groove 1253*a* in the rear gasket 1250, thereby mounting the rear gasket 1250 at a right position.

Figure 8:
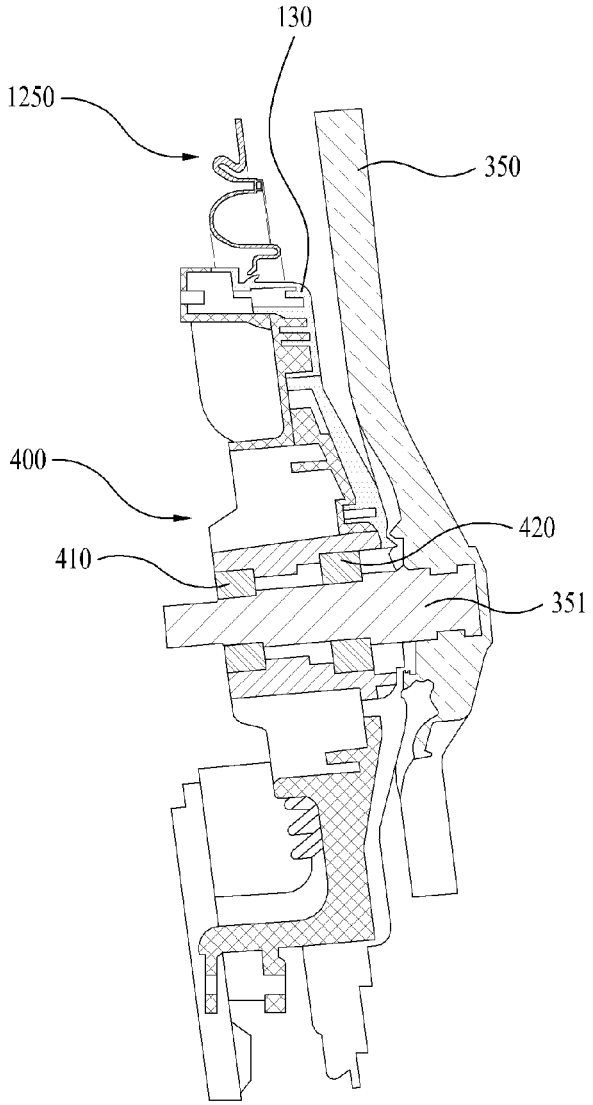

In the meantime, description will be made with reference to FIG. 8.

In the bearing housing 400, a front bearing 410 and a rear bearing 420 are mounted for supporting the rotation shaft 351. In this case, it is preferable that the tub back fastening portion 1300 of the rear gasket 1250 is coupled to the tub back 130 between vertical planes containing the front bearing 410 and the front bearing 420. If the tub back fastening portion 1300 is positioned on the vertical plane containing the front bearing 410, the motor is projected to a back side of the tub, making a capacity of the tub smaller.

In the meantime, the smaller the inside diameter of the rear gasket 1250, i.e., a diameter of the rear gasket 1250 connected to the tub back 130, the rear gasket 1250 comes to the rotation shaft of the drum the closer, when a gap between the bearing housing and the drum or the rear of the spider becomes the smaller, making a possibility the greater, in which the rear gasket 1250 is brought into contact with the drum and worn. Since the bearings are mounted in the bearing housing in a front side and a rear side thereof, with a middle portion of the bearing housing having a bearing supporting portion provided thereto to have a comparatively great front/rear direction width, a gap to the drum or the spider is comparatively small. Accordingly, the closer the inside diameter of the rear gasket 1250 to the rotation shaft of the drum, the greater the possibility of interference with the drum or the spider, which is not favorable. Taking these points into account, it is favorable that the inside diameter of the rear gasket 1250 is greater than the diameter of the motor.

The rear surface 128 of the tub has a pass through hole formed therein, and an outside circumference coupled to the rear gasket, wherein it can be said that the pass through hole in the tub is sealed by the tub back 130 and the rear gasket 1250. In this instance, since an assembly of the bearing housing and the motor has a comparatively large front/rear direction total width, it is favorable that the total width is made small as far as possible, and it is required that the assembly is mounted with a small gap to each of the drum (or the spider) in front thereof and the cabinet rear in rear thereof as far as possible. Accordingly, in sealing the pass through hole in the tub, it is favorable that the tub back 130 of a plastic injection molding is used for a central portion having relatively small spaces in front/rear directions, and the rear gasket 1250 is used for an outer portion of the central portion.

In the meantime, the rear gasket serves to connect an assembly (hereafter, a drum assembly) of the drum, the spider, the shaft, the bearing housing, the motor and so on to the tub. Since the rear gasket itself has a spring constant, if it is taken as a vibration system, the rear gasket acts as a spring with respect to the drum assembly. Though the rear gasket can be fabricated not to have spring constant as far as possible, it is unavoidable that the rear gasket has a certain extent of rigidity owing to reasons that the rear gasket is required to maintain a shape of the rear gasket itself and to endure the pressure of the water. Accordingly, the rear gasket can act as a spring with respect to the vibration of the drum assembly. However, even in such a case, it is preferable that the spring constant of the rear gasket is made not to exceed 8000 N/m. If the spring constant is high, the drum is liable to cause a problem due to irregular vibration of the drum in a steady state rotation section of higher than 400 rpm of the drum rotation speed. The spring constant of the rear gasket can be 6000 N/m. In spinning, there can be a transient vibration region in which amplitude of the vibration becomes greater due to resonance as the rotation speed increases, and if the transient vibration region is passed as the rotation speed of the drum increases more, the rotation speed of the drum arrives at a steady state region in which the amplitude to the drum becomes constant at a comparatively low level. The irregular vibration can be vibration phenomena in which the amplitude of the drum vibration becomes great and small repeatedly in the steady state region, or the amplitude of the drum vibration becomes great irregularly.

Figure 9:
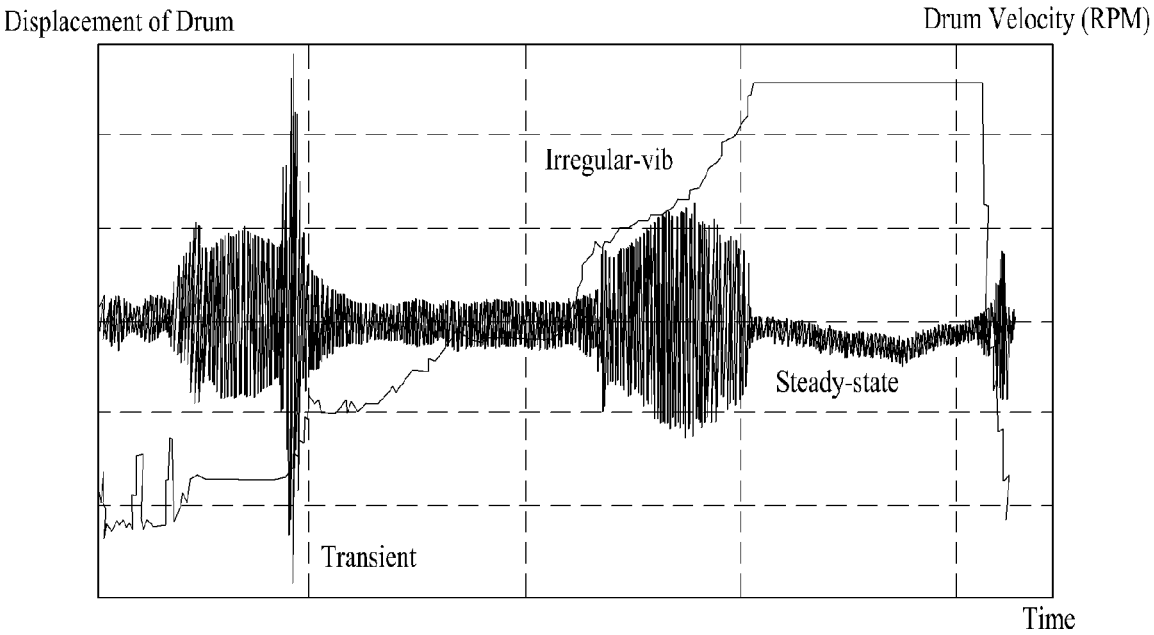
FIG. 9 shows a vibration characteristic which may occur in the embodied laundry machine.

In the meantime, a vibration characteristic of the washing machine of the present invention will be reviewed with reference to FIG. 9. As the rotation speed of the drum increases, a region (a transient vibration region) appears, in which transient vibration having great and irregular amplitude takes place. The transient vibration region is a vibration region having irregular and great amplitude before the vibration becomes comparatively steady (steady state vibration), which is in general a vibration characteristic which is fixed as a vibration system (the washing machine) is designed. The washing machine of the embodiment shows the transient vibration at about 200~350 rpm, which is considered to be transient vibration caused by resonance.

In the meantime, as described before, the washing machine in accordance with a preferred embodiment of the present invention has the motor, the drum connected to the motor and so on which are sources of the vibration connected through the tub and the rear gasket. Accordingly, the vibration does not transmit from the drum to the tub mostly, and the drum is supported by the suspension assembly which is buffering and supporting means (damping means). Therefore, the tub can be fixed to the cabinet without the damping means.

As a result of the inventor s study, in the washing machine, a vibration characteristic is found out you can not observe at a general washing machine. Though a general washing machine has the vibration (displacement) that becomes smaller and steady once the vibration passes the transient vibration region, the washing machine of the present invention has a region (called as irregular vibration) in which the vibration becomes greater again after the vibration passes the transient vibration region. As the result of the study, the irregular vibration takes place at about 400~1000 rpm region (called as an irregular vibration region). It is understood that the irregular vibration is caused by the ball balance, the suspension, and the rear gasket.

In the meantime, each of the first suspension 510 and the second suspension 520 can have a spring constant in a range of 7300~8300 N/m, and the third suspension 500 can have a spring constant in a range of 4500~5500 N/m. In the embodiment, each of the first suspension 510 and the second suspension 520 can have a spring constant of 7800 N/m, and the third suspension 500 can have a spring constant of 5000 N/m.

Along with this, as described before, the rear gasket can have a spring constant, to serve a function like the third suspension 500 in view of a vibration mode in which a fore end of the drum vibrates in up/down directions. Taking the rear gasket into account, the spring constant of the third suspension can be smaller than the first suspension 510 and the second suspension 520.

In this instance, in order to make the third suspension in front of the first suspension and the second suspension to exert more spring force, the spring may be compressed in advance in mounting the spring. Owing to gravity of the drum assembly, the suspensions can be compressed by certain distances, when the suspensions can be mounted such that the compressed length of the third suspension is greater than others. That is, by securing required spring force by making the spring constant of the third suspension smaller and the initial compressed distance greater, system stability can be secured.

In the meantime, the tub rear is mounted to have small movement with respect to the cabinet, and the drum assembly is mounted to be able to vibrate according to rotation of the drum. By using a connecting member placed between the tub rear and the drum assembly, which absorbs the vibration displacement of the drum assembly while connecting the tub rear to the drum assembly, it is made that the vibration of the tub rear is small as far as possible compared to the vibration of the drum assembly. There can be a variety of the connection member, and the rear gasket is one of the variations.

Despite of the name, the rear gasket can be formed of different materials. In general, other than materials used as gaskets, if a material can reduce transmission of the vibration from the drum to the tub, the material can be used in fabrication of the rear gasket. Along with this, the rear gasket can have any shape as far as the shape can minimize the transmission of the vibration to the tub.

INDUSTRIAL APPLICABILITY

The present invention relates to a laundry machine for treating laundry. The vibration transmission from the drum to the tub is reduced. Owing to the reduction of the vibration, the tub can be expanded closer to an inside surface of the cabinet, according to which a size of the drum also expanded to have an increased capacity laundry machine.

The invention claimed is:

1. A laundry machine comprising:

a tub to hold water therein, and the tub having an opening formed at a back side of the tub;

a drum rotatably provided in the tub;

a shaft connected to the drum;

a bearing housing to rotatably support the shaft;

a tub back located in the opening formed at the back side of the tub and fastened to a first side of the bearing housing;

a suspension unit attached to the bearing housing to reduce vibration of the drum;

a motor fastened to a second side of the bearing housing to rotate the shaft; and a flexible sealer including a tub connection portion connected watertightly to the opening of the tub, a tub back connection portion connected watertightly to the tub back, and a flexible portion connecting between the tub connection portion and the tub back connection portion for allowing the tub back to move relatively to the tub, wherein the tub back has a center portion, a rim extending axially backward from the center portion, a seating portion extending radially from the rim, and a first rib positioned on the rim between the seating section and the center portion extending radially from the rim so that a first groove is formed between the seating section and the first rib, and the tub back connection portion has a second rib and a third rib so that a second groove is formed between the second and third ribs and a projection adjacent to the third rib and extending radially, wherein the first rib is positioned in the second groove, and the third rib and the projection is positioned in the first groove when the tub connection portion is fastened to the tub back, wherein the flexible portion is more flexible than the tub connection portion or the tub back connection portion, and the flexible portion includes a plurality of straight portions inclined with respect to a straight line normal to a rotational axis of the shaft, and a curved portion connected to the plurality of straight portions, and the flexible portion has a flat portion to avoid an interference with the suspension unit.

2. The laundry machine as claimed in claim 1, wherein a flexibility of the flexible sealer is non-uniform in a radial direction.

3. The laundry machine as claimed in claim 2, wherein a thickness of the flexible sealer is non-uniform in the radial direction.

4. The laundry machine as claimed in claim 1, wherein a thickness of the tub connection portion and the tub back connection portion are greater than a thickness of the flexible portion.

5. The laundry machine as claimed in claim 1, wherein the flexible sealer includes three pairs of surfaces each pair of which has two surfaces facing each other in a radial direction, and wherein an interval between the two surfaces of a middle pair is greatest.

6. The laundry machine as claimed in claim 1, wherein the flexible sealer includes three pairs of surfaces each pair of which has two surfaces facing each other in a radial direction, and wherein an interval between the two surfaces of a middle pair is changed the most when the tub back is moved in a normal direction to a rotational axis of the shaft.

7. The laundry machine as claimed in claim 1, wherein the flexible sealer has a stiffness smaller than 8000 N/m.

8. The laundry machine as claimed in claim 1, wherein the flexible portion includes a portion extended towards the drum from the tub back connection portion.

9. The laundry machine as claimed in claim 1, wherein the flexible portion has an interference-avoiding portion including a clamp ring-avoiding portion for avoiding an interference with a clamp ring to fasten the tub back connection portion to the tub back and the flat portion for avoiding an interference with the suspension unit.

10. The laundry machine as claimed in claim 1, wherein a flexibility of the flexible portion is non-uniform in a radial direction.

11. The laundry machine as claimed in claim 10, wherein the flexible portion has a rib that is formed along the radial direction.

12. The laundry machine as claimed in claim 10, wherein a middle portion of the flexible portion is more flexible than an adjacent portion thereof.

13. The laundry machine as claimed in claim 1, wherein the plurality of straight portions are inclined at an angle less than 45 degrees with respect to the straight line.

14. The laundry machine as claimed in claim 13, wherein the plurality of straight portions are inclined at an angle less than 5 degree with respect to the straight line.

15. The laundry machine as claimed in claim 13, wherein the plurality of straight portions comprises an outer straight portion connected to the tub connection portion and an inner straight portion connected to the tub back connection portion, and wherein the curved portion is connected between the outer straight portion and the inner straight portion.

16. The laundry machine as claimed in claim 15, wherein the outer straight portion has a plurality of ribs formed along a radial direction.

17. The laundry machine as claimed in claim 15, wherein the outer and inner straight portions are spaced away from each other in a rotational axis of the shaft.

18. The laundry machine as claimed in claim 15, wherein the inner straight portion has a width greater than a width of the outer straight portion.

19. The laundry machine as claimed in claim 15, wherein a width of the inner straight portion changes along a circumferential direction.

20. The laundry machine as claimed in claim 19, wherein the inner straight portion has a greater-width portion to avoid an interference with a clamp ring.

21. The laundry machine as claimed in claim 13, wherein the curved portion is placed opposite to the drum with respect to the plurality of straight portions.

22. The laundry machine as claimed in claim 1, wherein a width of the flexible portion is greater than 10 mm.

23. The laundry machine as claimed in claim 1, wherein, with respect to a cross-section cut in a radial direction, a width of the flexible portion in the radial direction is greater than a width thereof in a rotational axis direction of the shaft.

24. The laundry machine as claimed in claim 1, wherein the tub has a bent portion that is bent in an opposite direction to the drum and is inserted into the tub connection portion.

25. The laundry machine as claimed in claim 24, wherein the tub connection portion has a portion extended to surround an inner curved portion of the bent portion.

26. The laundry machine as claimed in claim 1, wherein the tub connection portion or the tub back connection portion is fastened to the tub or the tub back with a clamp ring.

27. The laundry machine as claimed in claim 26, wherein the clamp ring is placed in the second groove.

28. The laundry machine as claimed in claim 1, wherein the tub is supported more rigidly than the drum supported by the suspension unit.

* * * * *